US005764777A

United States Patent [19]

Goldfarb

[11] Patent Number: 5,764,777

[45] Date of Patent: Jun. 9, 1998

[54] FOUR DIMENSIONAL ACOUSTICAL AUDIO SYSTEM

[75] Inventor: Barry S. Goldfarb, Deland, Fla.

[73] Assignee: BSG Laboratories, Inc., Deland, Fla.

[21] Appl. No.: 426,822

[22] Filed: Apr. 21, 1995

[51] Int. Cl.[6] ..... H04S 3/00

[52] U.S. Cl. ..... 381/27; 381/24

[58] Field of Search ..... 381/24, 27, 1

[56] References Cited

U.S. PATENT DOCUMENTS 5,199,075 3/1993 Fosgate ..... 381/24

OTHER PUBLICATIONS

Griesinger, David, "Theroy and Design of a Digital Audio Signal Processor for Home Use", J. Audio Eng. Soc., vol. 37, No. 1/2, 1989, Jan./Feb., pp. 40–50.

Bailey, T. and J.E. Hubbard, "Distributed piezoelectric–polymer active vibration control of a cantilevered beam," AIAA Journal of Guidance and Control, pp. 605–611, vol. 8, No. 5, Sep.–Oct. 1985.

Burke, S.E. and J. Hubbard, "Active vibration control of a simply supported beam using a spatially distributed actuator," IEEE Control System Magazine, pp. 25–30, Aug. 1987.

Clark, R.L., R.A. Burdisso and C.R. Fuller, "Design approaches for shaping polyvinylidene fluoride sensors inactive structural acoustic control. "The Journal of Intelligent Materials Systems and Structures, pp. 354–365, vol. 4, Jul. 1993.

Crawley, E.F., and J. de Luis, "Use of piezoelectric actuators as element of intelligent structures," AIAA Journal, pp. 1373–1385, vol. 25, No. 10, Oct. 1987.

Fahy, F. 1985. Sound and Structural Vibration, Academic Press, New York pp. 241–260.

Guyton, A.C. 1991. Basic Neuroscience: Anatomy and Physiology, W.B. Saunders Company, Harcourt Brace Jovanovich, Inc., Philadelphia, pp. 177–187.

Hebrank, J.H. and D. Wright, "Are two ears necessary for the localization of sound sources on the median plane?," Journal of the Acoustical Society of America, pp. 957–962, vol. 56, No. 3, Sep. 74.

Hebrank, J.H. and D. Wright, "Spectral cues used in the localization of sound sources on the median plane," Journal of the Acoustical Society of America, vol. 56, No. 6, Dec. 74.

Kinsler, L.E., A.R. Frey, A.B. Coppens and J.V. Sanders, 1982. Fundamentals of Acoustics, Third Edition, John Wiley & Sons, Inc., Canada, pp. 246–278.

Lee, C.K., and F.C. Moon, 1990. "Modal sensors/actuators," ASME Journal of Applied Mechanics, 57, pp. 434–441.

Nelson, P.A. 1994. "Active control of acoustic fields and the reproduction of sound," Journal of Sound and Vibration, 177(4) pp. 311–319.

(List continued on next page.)

*Primary Examiner*—Forester W. Isen
*Attorney, Agent, or Firm*—Quarles & Brady

[57] ABSTRACT

A four-dimensional acoustical audio system utilizes both spatial and temporal signal processing to maximize the depth, width, and perceived directionality of the acoustic field with respect to the binaural auditory system. Transducers are critically placed within the confines of a reverberant enclosure, and each transducer is assigned a specific bandwidth of sound either in mono or stereo, depending upon the spatial location of the transducer to take advantage of the binaural auditory system of the intended listener. The system minimizes the number of transducers and electronics required to achieve the effect of a live performance, regardless of the dynamics of the enclosure in which it is placed. The loudspeaker system can be used in small enclosed volumes such as an automobile or extended to volumes the size of a motion picture theater or concert hall and even outdoors.

38 Claims, 12 Drawing Sheets

OTHER PUBLICATIONS

Morse, P.M. and K.U. Ingard, 1986, Theoretical Acoustics, Princeton University Press, pp. 576–599.

Pierce, A.D., 1989, Acoustics, Acoustial Society of America, pp. 284–286.

Roffler, S.E. and R.A. Butler "Factors that influence the localization of sound in the vertical plane," Journal of the Acoustical Society of America, pp. 1255–1259, vol. 43, No. 6, 1968.

Stevens, S.S., and E.B. Newman, 1936, "The localization of actual sources of sound," American Journal of Psychology, 48, pp. 297–306.

Wallach, H., E.B. Newman and M.R. Rosenzweig, "The precedence effect in sound localization," American Journal of Psychology, pp. 315–336, vol. LXII, No. 3, Jul. 1949.

Yost, W.A. and D.W. Nielsen, 1985, Fundamentals of Hearing, Holt Rinehart and Winston, New York, Second Edition, pp. 151–170.

FOUR DIMENSIONAL ACOUSTICAL AUDIO SYSTEM

FIELD OF THE INVENTION

The invention relates to audio systems, and is more particularly concerned with spatial and temporal signal processing techniques for loudspeaker design to achieve optimal psychoacoustic impact.

BACKGROUND OF THE INVENTION

The reproduction of music, identical to that which would be perceived in a concert hall or a live performance, has been the objective of many in the audio industry for years. In more recent years, digital signal processing has often been considered for the reconstruction of a sound field by concurrently measuring the acoustic response of the field and then modifying the input to an array of loudspeakers to produce the appropriate velocity and pressure within the fluid medium. As detailed in a recent publication by Nelson, P. A., 1994, "Active control of acoustic fields and the reproduction of sound," *Journal of Sound and Vibration*, 177(4), pp. 447–477, this approach is somewhat ludicrous in terms of practical implementation. One need look only to the Kirchhoff-Helmholtz integral equation to verify this statement. In theory, it is possible to identically recreate a sound field within a volume by placing monopole and dipole sources about that volume and reproducing the pressure and velocity field. As detailed by Nelson, the linear separation between discrete monopole/dipole source elements used to generate a planar continuous source array should not exceed a half wavelength ($\lambda/2$) at the frequency of interest. Thus, to reproduce a sound field identical to the original within a spherical volume would require approximately $4\pi D^2/\lambda^2$ individual source elements. In words as opposed to mathematics, to identically reproduce a sound field with an array of transducers over a frequency range extending from 20 Hz to 10 kHz and for a sphere of 10 m diameter would require over 1 million individual sources! Even if the frequency range were limited to 1 kHz and the diameter of the sphere were reduced to 1 m, approximately 100 transducers would be required.

This example emphasizes the need for a new approach and philosophy to the reconstruction of sound fields that minimizes the number of sources required, the complexity of the electronics, and yet takes advantage of the physiological processes by which humans hear, the binaural auditory system, to maximize the depth, width, and perceived directionality associated with the sonic image. It is desirable to provide a system that generates a sound field from the perspective of the physical or acoustical range as oppose to the artificially electronically induced realm.

It has been determined that a typical stereophonic sound reproduction system designed for realistically recreating a sound stage according to AES standards for hi-fi, predominantly contains at least two distinct signals, one containing the information pertaining to that which should be heard by the right ear of the listener and one containing the information pertaining to that which should be heard by the left ear of the listener. Contemporary sound reproduction systems rely on three subsystems of transducers as illustrated in FIG. 1. One subsystem is a left enclosure 2 directed at a listener or listening area 4 from the left. Another subsystem is a right enclosure 6 directed at a listener or listening area 4 from the right. Each subsystem produces the appropriate sound for the side of the listener 4 at which it is directed. The third subsystem contains the information for the sound at the lower frequency limit of human hearing, which in typical systems is 500 Hz and below. The third subsystem transducer 8 may be placed centrally in front of or behind the listener 4 because it is generally accepted that these low frequencies are somewhat omni-directional as a result of the characteristic distance between the ears, approximately 0.2 m for a typical person.

In the subsystems devoted to the left and right channels, there are often multiple transduction devices mounted within each respective speaker cabinet, each transducer capable of producing a limited frequency range with appropriate crossover networks to "match" the sensitivity of each transduction device over the intended bandwidth. These "satellite" loudspeaker systems incorporate only one aspect of psychoacoustic perception into the design.

According to one aspect of the invention, to achieve greater depth and width of field acoustically, one must separate the transduction devices both spatially and temporally to match what is known about the directionality of sound in the azimuthal plane (referring to azimuthal in FIG. 1 and median or sagittal plane perpendicular to the azimuthal and bisecting the human symmetrically), yet known audio design, with a focus on stereophonic experience, does not account for this separation of auditory responsibility.

Stereophonic sound can best be described as the science of three dimensional sound. It is an ever evolving, inexact science involving physics, psycho-acoustics and audio electronics. In its simplest form, the most common stereophonic standard consists of two channels of signal information.

Some of the criteria used for stereophonic realism involve spatiality—the ability for a given sound to be captured in a hall, where the various reflections are recorded and later played back; timbre—the color of the sound; and phase linearity—all frequencies arriving in time, in phase without distortions. These and other issues, such as dynamics, intermodulation distortions, mechanical distortions and a host of other objective and subjective concerns make up a glimpse into the world of stereophonic sound.

Yet, audio design using a stereophonic model is driven by a restricting standard. This standard requires that the way in which an artist is recorded in the recording studio, or on stage, is the same way in which the listener will hear the recording played back. This standard has essentially been centered around a two channel, two speaker model.

In a dual loudspeaker set up, two speakers are set apart from each other (in front of the listener), at a distance optimum to produce a realistically proportioned illusionary sound stage. This sound stage is the result of cross talk, arrival time to the ear-brain relationship in time and space relative to the original recording. The illusion, however, is just that—an illusion, an effect, and this effect has become the industry standard.

With this standard, manufacturers, inventors and marketeers compete to perfect reality within the confines of the standard, through such things as improved transparency, blossom, space, clarity, timbre, imaging, sound stage and a host of other objective and subjective goals which define the criteria.

The prior art demonstrates an objective to improve upon one or more of the goals of this industry standard. Some manufacturers and inventors have recognized that all frequencies do not need to be contained in two loudspeaker boxes, but that one can separate the low frequencies from the high frequencies and produce a desirable and even improved sound stage using "three" loudspeaker enclosures.

In an automobile, which provides an acoustically sealed environment, the illusion can be enhanced when two more "rear fill" speakers are employed at the rear deck of a sedan to aid in the reflective ambience otherwise lost through carpet and seats.

Yet, the advances strive for improvement in a two speaker stereophonic model. The separation of transducers dedicated to different frequency ranges, commonly referred to as satellites, is largely driven by the need to separate the tasks of amplifiers so that the increased power needed for very low frequency signals does not undermine the signal quality in the mid and upper frequency range.

Beyond the two channel "hi fi" stereophonic playing field, there is motion picture theater sound and its advances, for example, Holman THX as described in U.S. Pat. No. 4,569,076. Yet, again, the objective is not to dissimilar from that of high fidelity stereophonic systems. Here, the criteria for excellent theater sound requires that the audience hears what the director heard in the screening room.

Thus, whether a given demand calls for stereophonic two channel sound, or a multi-channel movie theater matrix, the loudspeakers, amplifiers, signal processors and wires are all designed to perform within the confines of the established standards.

As to the standards themselves, there are recording processes which enable these standards to exist, and, within the processes are standards, such as Dolby.

Additionally, it is important to recognize that all systems and all standards have thus far utilized and specified the need for full band width audio in nearly all cases. As used throughout the application, full band width is defined in ASO as 20 Hz to 20 kHz and in ISO as 16 Hz to 16 kHz.

In the cases in which frequency fragmentation groups have been employed, such as the types used for large concerts, and other prosound and high end applications, the fragmentations are phase arrayed and are meant to be constant-directivity-based solutions. These bi-amped systems are no different from a traditional loudspeaker in terms of their end goal, and as such are not discrete self-contained systems designed to perform for a specific discrete processing function.

In the past ten years, signal processing, and in particular, digital signal processing has become the most significant breakthrough to the science of stereophonic, or three dimensional sound. These digital signal processors (DSP) are programmed to perform tricks to fool the ear into believing that the sonic image is bigger than it really is, or more life-like, or more three dimensional. Yet, the focus of the processing of a signal has been on the input side and not specifically from the acoustical side.

The ear-brain relationship may be tricked into believing something is larger, or more reverberant, through illusionary psychoacoustic DSP, but the ear is an amazing instrument. With all the advances in audio electronics, an average person can usually discern the difference between a recorded sound and the real thing.

In a movie theater environment, we are suspended in our willingness to believe something is real, when in fact we know it isn't. We marvel at the technological wonder on the screen of a jet fly-by, or the soft splash of the whale, or the screeching tires of the gangsters' car. How realistic! Yet, perhaps it is only when we are in a theater projecting sound through a state of the art sound system and a real thunder clap strikes outside the theater that we fully come to understand reality versus the theater sound.

We are a society approaching a paradigm shift in our culture. Perception itself is being questioned throughout the arts and the sciences. Virtual Reality, Multi-Media, and MIDI-based music synthesis are examples of the strives in technology to meet the thirst for reality in the reproduction. These converging technologies, combined with advanced simulation technologies, previously limited to military training, are now being made available to the average person at special venue amusement parks and attractions. Soon, these new formats will enter our homes.

The ability for us to "enter the experience" cannot occur using conventional audio technology and loudspeaker systems, regardless of how many channels are employed. Our philosophical approach to acoustical applications must be revised before this can occur. The very process of sound distribution here entails a uniquely different approach. One cannot simply place a device designed to produce a given result and put in into an environment it was never intended for and expect ideal results.

Today, musicians and composers are no longer limited to having to perform on stage to a traditional audience the way it has been done for centuries. Through MIDI and multi channel recording, one composer, alone, can bring to life the sounds previously requiring an entire symphony orchestra. No longer are there boundaries or restrictions. Yet, we play back through the same loudspeaker. loudspeaker used to provide stereophonic standards.

Within the stereophonic standard, there is a constant drive to achieve linearity of response. This goal is so overwhelming, that compromises of other aspects of sound are made to achieve it. The focus shackles the development of systems that more accurately and efficiently emulate reality.

SUMMARY OF THE INVENTION

It is an object of the invention to provide a four dimensional acoustical audio system that combines the selection of transducers, the placement of those transducers and the spectral separation of frequency to the transducers to optimize the psychoacoustic effect to the observer.

It is another object of the invention to provide the psychoacoustic experience to the observer with a focus on the binaural auditory system of the observer and not the audio source.

The achievement of these objects according to the invention requires a merger of different aspects, namely, transducer type, spatial placement and frequency fragmentation of audio design, without limitation to the stereophonic models of the existing technology. The invention manifests itself in a variety of embodiments set forth more fully below, but each premised on a discovery of the merger of distinct aspects of the audio system design.

According to the invention, however, these individual aspects should preferably not be used alone. For example, while an excessively large quantity of transducers can be utilized to achieve a desired auditory effect, the optimization of transducer type with placement and appropriate frequency separation can reduce the number of transducers needed to produce the effect and yet produce a more realistic effect.

Spatial placement according to the invention has the function of establishing the acoustic framing of the auditory experience being created. According to the invention, the placement varies according to the application and is coordinated with the transducer selection and frequency fragmentation to optimize the experience of the application.

The acoustic frame established can be varied as to what frequency groups are chosen for a particular job. In a theater environment or other setting in which the audience is oriented toward a screen or stage, a 360° tweeter placed behind the listener will cause the pinna to recognize a slight "spatial" increase in the room. When power balanced together with the spectrum (4 kHz and up) the psychoacoustic "illusion" begins to place the listener "IN" the experience. Thus, it is the merger of transducer type, placement and frequency separation that optimizes the experience.

A four dimensional acoustical audio system has been designed which takes advantage of both spatial and temporal signal processing in accordance with the process by which the binaural auditory system processes sound to increase the width and depth of the "sonic image" and increase the "sweet spot" typically associated with stereophonic sound reproduction.

In an embodiment according to the invention, the effect is achieved, for example, by placing one or two sub-woofers with a preferably summed-to-mono input ranging in frequency from 0 Hz to 250 Hz in one or two of the front corners of the enclosure and a mid-bass driver with a preferably summed to mono input ranging in frequency from 150 Hz to 3 kHz at the "center stage" of the audience. A stereophonic image is created with a left and right audio loudspeaker having inputs ranging in frequency from 900 Hz to 12–16 kHz, each preferably placed midway between the front and back of the enclosure on the left and right walls of the enclosure, respectively. By placing the drivers centrally on the side walls of the enclosure, maximum directionality of the sound source is achieved by interaural intensive difference processing, used by the ear to determine the direction from which a sound emanates at high frequencies. A fourth driver, a high frequency device having a preferably summed-to-mono input with a frequency range of 4–6 kHz to greater 20 kHz, is placed at the rear of the enclosure to create the effect of a "live" room. By placing this driver at the rear of the audience, the pinna naturally filters the sound radiation and thus delivers an attenuated sound to the ear which is perceived as a reflection and thus generates the effect of a more reverberant sound field.

The resulting acoustical field not only creates an auditory environment for the observer in the enclosure that places the observer "in the experience" but also emulates the reality such that an observer outside the enclosure senses a realistic acoustical image is occurring within the enclosure.

The invention in its various embodiments provides a new approach to sound design by synergistically combining transducer selection, placement and frequency fragmentation to provide realistic sound experiences beyond the limits of conventional stereophonic models.

BRIEF DESCRIPTION OF DRAWINGS

A more thorough understanding of the invention can be gained from the following detailed description in conjunction with the accompanying drawings, in which.

DESCRIPTION OF PREFERRED EMBODIMENTS

Figure 1:
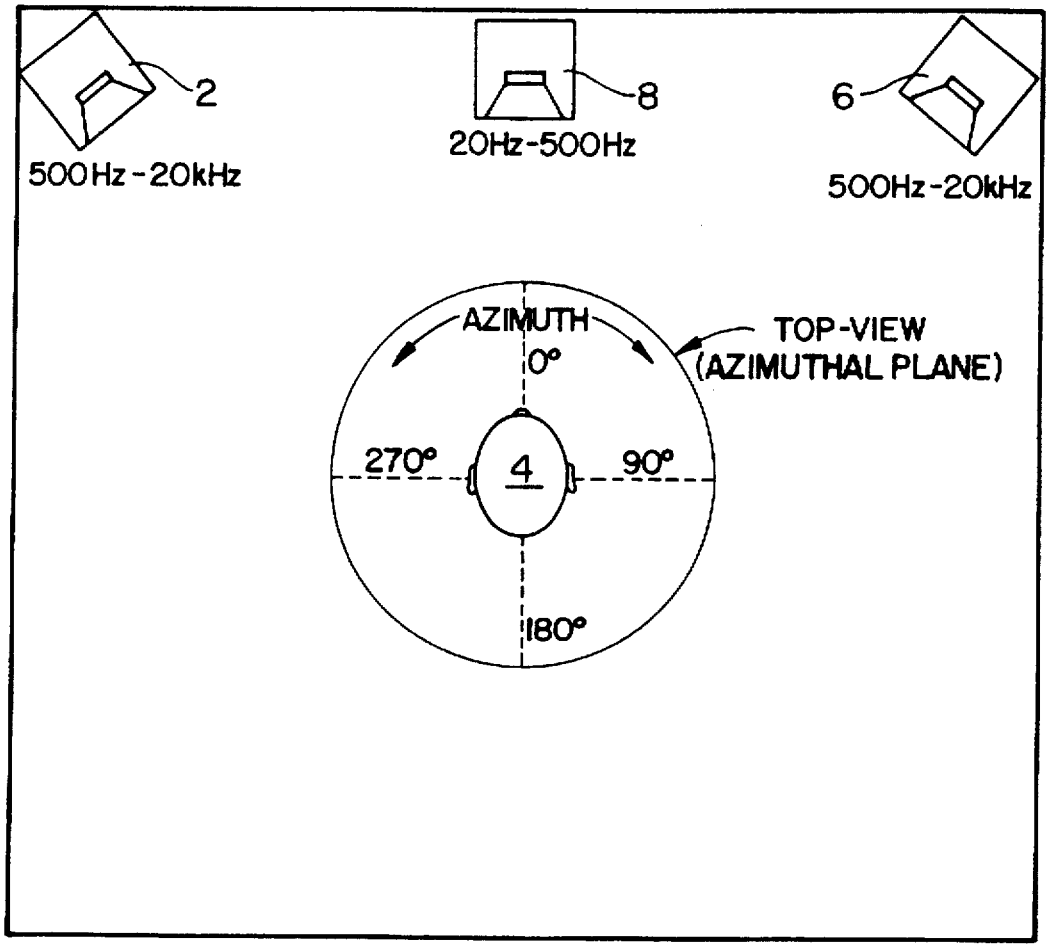
FIG. 1 is a top plan view of a prior art stereo arrangement with a sub-woofer satellite.

The invention relates to the reproduction of sound from recordings made on various media to imitate the initial sound produced at the time of recording. The invention is suitable for use within enclosures with volumes ranging from that of a typical automobile to a theater with a volume of over 400,000 cubic feet. The invention even has application in outdoor environments. This disclosure is directed to embodiments of the invention relating to the creation of a sound stage for listeners oriented in a particular direction, such as toward a motion picture or video screen or performing stage. The experience created, not only realistically places the listener in the room or enclosure in the experience, but also projects a realistic image to an observer outside the enclosure or room that the performance is occurring inside the room. The invention can have other applications in commercial environments to create a homogeneous sound field along a horizontal plane of listening, such as the ear level of seated diners in a restaurant. These commercial applications of the invention are explored in a copending application.

The objective of the four dimensional acoustical audio system, through certain embodiments, is to increase the width and depth of the sonic image presented to the audience and thereby create a widened "sweet spot" so that the sound reproduction has greater uniformity and can be enjoyed by a variety of listeners, independent of their specific position within the enclosure. To achieve this effect, both spatial and temporal signal processing are used to shape the acoustic field. Spatial signal processing relates to the specific location of the transducer (driver) within the reverberant enclosure and has been applied to the control of reverberant structures in recent years as outlined by Clark, R. L., R. A. Burdisso and C. R. Fuller, 1992. "Design approaches for shaping polyvinylidene fluoride sensors in active structural acoustic control," *The Journal of Intelligent Material Systems and Structures*, 4, pp. 354–365; Bailey, T., and J. E. Hubbard, 1985. "Distributed piezoelectric-polymer active vibration control of a cantilevered beam," *AIAA Journal of Guidance and Control*, 6 (5), pp. 605–611; Burke, S. E., and J. Hubbard, 1987. "Active vibration control of a simply supported beam using a spatially distributed actuator," *IEEE Control System Magazine*, pp. 25–30; Crawley, E. F., and J. de Luis, 1987. "Use of piezoelectric actuators as elements of intelligent structures," *AIAA Journal*, 25(10), pp. 1373–1385; Lee, C. K., and F. C. Moon, 1990. "Modal sensors/actuators," *ASME Journal of Applied Mechanics*, 57, pp. 434–441. Temporal signal processing relates to the use of active filters to selectively achieve desired bandwidths of operation for specific transduction devices.

As used herein, four dimensional refers to the use of the three spatial dimensions and time as a fourth dimension to create the acoustical sound field desired.

Combining both spatial and temporal signal processing affords the loudspeaker designer with a degree of freedom and flexibility not previously explored to its full potential. Spatial and temporal signal processing can be combined for optimal performance with respect to the binaural auditory system, namely human ears (the transducers for which this system is intended) as opposed to a microphone placed at some fixed distance in an anechoic environment as in conventional loudspeaker design performance assessment. The loudspeaker systems of this invention are not designed to meet some specified frequency response characteristics in an anechoic environment as the transducers are spatially separated within the enclosure, independently filtered (actively), and amplified to recreate the desired acoustic response. In contrast to traditional design implementations, the acoustical systems envisioned by the invention are spatially and temporally optimized within the enclosure to take advantage of the binaural auditory system and maximize the perceived width, depth, and directionality of the sound field.

Because the loudspeaker systems are designed for the binaural auditory system, it is appropriate to review this biological system here. Stereophonic loudspeaker systems take advantage of the human ability to resolve the direction from which sound emanates. Binaural hearing is required to physically locate stimuli in the real world, and there are two basic methods by which the location of a sound source is determined. Each is distinctly different and has an effective bandwidth of operation. Firstly, the interaural time difference (ITD) in the arrival of a sound wave at each respective ear can be used to determine the direction from which the sound emanated. At relatively low frequencies, below 1500 Hz, the wavelength of the sound wave is greater than the characteristic dimension between the ears (approximately 0.2 m for a typical person). Thus, a distinct time delay in the propagation of the sound wave can be resolved. While this method of resolving the direction can be effective up to 3000 Hz, it has limited accuracy between 1000 Hz and 3000 Hz as the acoustic wavelength decreases. At frequencies greater than 3000 Hz, the primary method of resolving the direction of a sound source is based upon the interaural intensive difference (IID). At higher frequencies and decreasing acoustic wavelength, sound waves are partially blocked by the effective "baffle" created by the head if the source is not positioned directly in front of the listener. Thus, variations in sound intensity presented at each ear help in discerning the location of a source at relatively high frequencies.

In reverberant, enclosed, sound fields, the sound originating from a source will bounce off the walls several times in various directions until it decays sufficiently to be inaudible. However, for transient acoustic waves, extensive testing has shown that the direction from which a sound first arrives is perceived to be the location of the source even if the reflected (delayed arriving signal) is larger than the first arriving signal (Moore, 1989).

Oddly enough, the frequency range in which directional information is difficult to discern by either ITD or IID is in a range of 1 kHz to 3 kHz where the sensitivity of the ear to sound is quite high. Accordingly, a single mono sound source placed in front of an audience with an upper frequency limit of approximately 3 kHz and will not have a dramatic effect on the perceived direction of the sound over the audible range, but can be effectively used to create the center stage.

At higher frequencies, it is imperative to have both left and right stereo signals if stereophonic imaging is desired. In fact, based upon the IID method of detecting the position of a sound source, the optimal location of the stereophonic transducers producing sound in the approximately 900 Hz to 16 kHz bandwidth are at opposite sides of the listener to maximize the IID. At low frequencies, the acoustic wavelength is so long that a listener cannot accurately resolve the direction of the source (because the sound heard at either ear is nearly in phase), so a sub-woofer (0 to 250 Hz bandwidth) can be placed in the corner of the enclosure (at the front) to maximize the coupling to the room dynamics. Finally, a single mono high frequency device (approximately 4–6 kHz to >20 kHz bandwidth) can be located near the rear of the audience or centrally overhead to achieve the effect of greater reverberation. The pinna (outer ear) serves to diminish the sound by virtue of reflection and diffraction at high frequencies when the sound wave is presented from behind. Acoustic waves reflected in a reverberant field also impinge the ear at reduced intensities than that of the original wave. Thus, placing a higher frequency driver at the rear of the audience can achieve the psychoacoustic impact of a more "live" acoustic field as opposed to the more complex use of full-bandwidth transducers and signal processing to achieve the same desired effect.

All of the prior considerations have been taken into account by the design of one embodiment of the four dimensional acoustical audio system set forth herein. Conventional performance specifications in terms of the system sensitivity lose meaning here because the sound system provided by this invention is designed for the transduction devices used in the binaural auditory system, not a microphone positioned at a fixed distance from a speaker mounted in a baffle. Quality transduction devices are used in this system since the timbre that each device is capable of reproducing is critical to the overall performance of the system. In addition, the relative sensitivity of each transducer is not as important as is the location of each device in the enclosure, coupled of course with the associated temporal filtering which is unique to the position of the device within the enclosure. The loudspeaker systems of the invention are not limited to home audio systems, but by virtue of design can be applied within any reverberant enclosure, regardless of dimensions, to achieve the same desired effect: 1) an increase in the sonic depth and width of the enclosure, 2) the impact of a live performance, and 3) an increase in the perceived "liveness" of the room acoustics.

Figure 2:
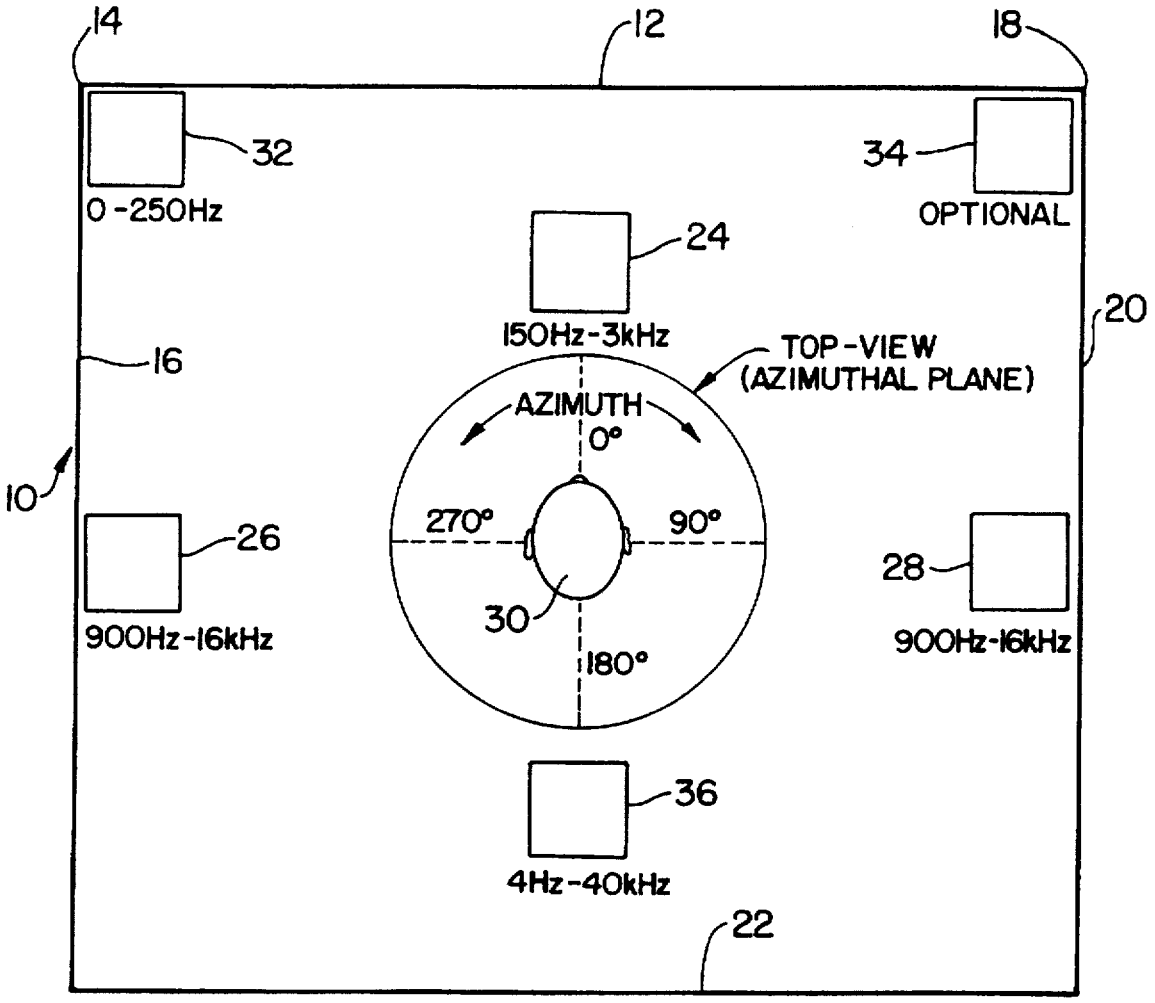
FIG. 2 is a top plan view of the spatial arrangement of loudspeakers according to an embodiment of the invention.

The present invention provides unique methods of utilizing spatial and temporal signal processing with conventional loudspeaker transduction devices to maximize the width and depth of the sonic image in a four-dimensional (time being the fourth dimension), reverberant sound field, regardless of the spatial dimensions of the sound field. Referring to FIG. 2, an embodiment of the invention for immersive observation by a binaural auditory system, such as human ears, is provided for use in an enclosure. As used throughout, observation refers to the facts that the observer may not only listen to the sound but may also feel vibrations from the system as part of the complete experience.

An enclosure 10 can be a room of a residential dwelling, a theater, a conference room or any other enclosed environment for presenting sound to an audience facing in a predetermined direction. The enclosure 10 includes a front wall 12 adjoining, at a first corner 14, a left wall 16 and, at a second corner 18, a right wall 20, the left wall 16 and the right wall 20 extending rearwardly from the front wall. The enclosure can further preferably includes a rear wall 22, a floor and a ceiling (not illustrated). The enclosure can further include doors, windows and other openings (not shown).

An embodiment of the invention directed to the audio experience for an audience facing a predetermined forward direction includes at least one central audio loudspeaker 24 placed substantially centrally between the left wall 16 and the right wall 20. The central audio loudspeaker 24 has an input filtered to range in frequency from substantially 150 Hz to no more than 10 kHz. The input to the central audio loudspeaker 24 should be limited in frequency to 6 kHz, or even preferably to 3–4 kHz. The central audio loudspeaker can be any of a variety of loudspeakers capable of performing in the frequency range specified but is preferably selected to have an optimal sensitivity and performance in the input range.

The embodiment for immersive observation further includes a left audio loudspeaker 26 placed adjacent the left wall 16 and a right audio loudspeaker 28 placed adjacent the right wall 20 of the enclosure 10. The left audio loudspeaker 26 and the right audio loudspeaker 28 can be spaced from the walls 16, 20 to varying degrees, provided that the loudspeakers 26, 28 are spaced apart to allow the observer 30 to sit or stand between them. While it is preferred that the left audio loudspeaker 26 and the right audio loudspeaker 28 be located directly to the sides of the observer 30, it is within the scope of the invention that the loudspeakers 26, 28 may be forward or rearward of these exact positions, but the left audio loudspeaker 26 and the right audio loudspeaker 28 are preferably located rearward of the central audio loudspeaker 24 relative to the wall front 12. Moreover, a plurality of loudspeakers having the same frequency parameters as the left audio loudspeaker 26 and the right audio loudspeaker 28 can be arranged along the left and right walls 16, 18, respectively.

According to the invention, said left audio loudspeaker 26 and said right audio loudspeaker 28 each having an input filtered to range in frequency from substantially 900 Hz to at least substantially 12 kHz, whereby the left audio loudspeaker 26 and the right audio loudspeaker 28 create a maximum width of the acoustic image and produce a stereophonic effect. The frequency range of the left audio loudspeaker 26 and the right audio loudspeaker 28 can extend to 16 kHz. The left and right audio loudspeakers can be any of a variety of loudspeakers capable of performing in the frequency range specified but are preferably selected to have an optimal sensitivity and performance in the input range.

In combination with the left audio loudspeaker 26 and the right audio loudspeaker 28, the central audio loudspeaker 24 creates a central image and greater depth to the sound field.

The embodiment for immersive observation preferably further comprises at least one sub-woofer audio loudspeaker 32 having at least one low pass filtered input having a cutoff frequency less than 1000 Hz and preferably below 600 Hz. According to the invention, it is desired to limit the sub-woofer audio loudspeaker performance to below 600 Hz to avoid localization of the low frequency signal while allowing production of the overtones approaching 550 Hz that contribute to the realism of the low frequency sound. The sub-woofer input can be further limited to below 250 Hz.

According to the invention, the sub-woofer audio loudspeaker 32 is coupled to dynamics of the enclosure by being placed adjacent a wall of the enclosure. The sub-woofer audio loudspeaker 32 is preferably disposed in one of the corners 14. The system can include a second sub-woofer audio loudspeaker 34, placed in the other corner 18. The sub-woofer loudspeaker can be any of a variety of loudspeakers capable of performing in the frequency range specified but is preferably selected to have an optimal sensitivity and performance in the input range. The sub-woofer audio loudspeaker can be driven by an output channel of a separate amplifier that combines the two channel input from the audio source. Alternatively, the sub-woofer audio loudspeaker can be driven by one of the outputs of a multichannel amplifier that processes the two channel input from the audio source.

The preferred embodiment of the immersive sound system further includes a high frequency device or transducer 36 with a frequency bandwidth extending from approximately 4–6 kHz to the limit of the device, which is typically greater than 20 kHz, but at least 15 kHz. The amplifier for the high frequency device, be it a part of a multi channel amp or a dedicated amplifier for the high frequency device, preferably is equipped to sum the two signal input from the audio source to a mono output to the high frequency device.

The high frequency device 36 is preferably mounted at the rear and centrally in the ceiling of the enclosure, that is, vertically higher than the left and right audio loudspeakers. The high frequency device 36 should be placed rearwardly from the front wall 12 no less than the distance the left audio loudspeaker 26 and the right audio loudspeaker 28 are placed rearwardly from the front wall 12. The high frequency device 36 can be provided by any of a variety of transducers capable of providing high quality sound in the specified range.

Figure 2A:
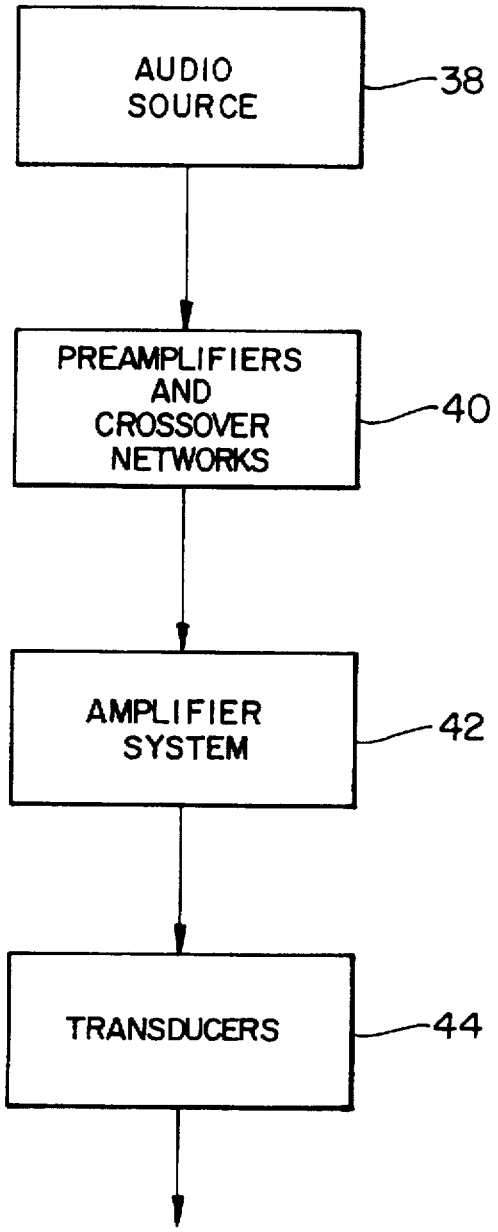
FIG. 2*a* is a block diagram of the audio system from source to output.

Referring to FIG. 2*a*, the audio system for providing driving signals to the loudspeakers includes an audio generating source 38 for generating a plurality of channels or audio signals and may be a CD player, film soundtrack, VCR player or tape deck. The audio source 38 is fed to signal processing electronics 40 which can include preamplifiers and cross over networks to amplify the signal and use either active or passive crossover networks to separate the frequencies but with predetermined overlaps for the different loudspeakers. The crossover network can produce two or more channels in the frequency range from substantially 900 Hz to 12 Khz for the left and right audio loudspeakers. The signal processing electronics 40 also produces a summing monophonic signal from the two or more channels from the high frequency signals above 5 kHz to drive the high frequency device. The signal processing electronics further produces a summing monophonic signal from the two or more channels from the low frequency signals to drive the sub-woofer and the central audio loudspeaker and use two or more overlapping frequency bands.

The signals generated by the signal processing electronics 40 are amplified by an amplifier system 42 to drive the transducers or loudspeakers 44 of the system. The amplifier system 42 can include a single audio amplifier for receiving two or more channel input and producing multiple channel output. Alternatively, the central audio loudspeaker 24 can be driven by a first audio amplifier and the left audio loudspeaker 26 and the right audio loudspeaker 28 can be driven by a second audio amplifier. The central audio loudspeaker, the sub-woofer and the high frequency device can likewise be driven by separate amplifiers supplied with the appropriately filtered and summed-to-mono signals.

The novel positioning (spatial signal processing) and frequency bandwidth (temporal signal processing) of each transduction device illustrated in FIG. 2 is critical in the development of a four dimensional sound field with a greater perceived sonic width and depth than conventional loudspeaker systems and thus an expanded "sweet spot" within the enclosure. The electronic signals sent to drivers 24, 32, 34 and 36 are preferably all mono, as opposed to stereo. The only stereo signals of the preferred embodiment are sent to drivers 26 and 28. The left and right stereo signals sent to transducers 26 and 28 are required by the binaural auditory system to effectively "locate" or "position" the stimuli audibly.

In the azimuthal plane, there are two principal mechanisms involved in determining the direction from which a sound emanates: 1) interaural time difference (ITD) and 2) interaural intensive difference (IID). Interaural time difference (ITD) utilizes the time delay between sound entering each opposing ear to resolve the direction from which it emanates. This method functions best at frequencies below approximately 1667 Hz, assuming the width of the head is approximately 0.2 m since the wavelength (Λ) of sound at 1667 Hz is approximately 0.2 m in air where the speed of sound (c) is approximately 340 m/s. However, depending upon the angle of incidence, ITD processing can have a limited effect up to approximately 3000 Hz. Interaural intensive difference (IID) utilizes variation in the sound intensity at each ear to resolve the direction from which the sound emanates. The head of the observer 30 serves as a baffle, causing incident sound waves to reflect and diffract at higher frequencies (greater than 3000 Hz), resulting in significantly different levels of intensity depending upon the angle of incidence. As might be expected, there is a bandwidth over which neither works most effectively (approximately 1000 Hz to 3000 Hz) since the ITD is too large to accurately determine the direction and the IID is too small to determine the direction. Stevens, S. S., and E. B. Newman, 1936. "The localization of actual sources of sound," *American Journal of Psychology*, 48, pp. 297–306.

According to the invention, the central loudspeaker 24 positioned at "center stage" can be supplied with a mono signal between 150 Hz and 3000 Hz, which fills the listening environment with low to mid frequency sound waves without deteriorating the stereophonic image created by the left audio loudspeaker 26 and the right audio loudspeaker 28.

Figure 3:
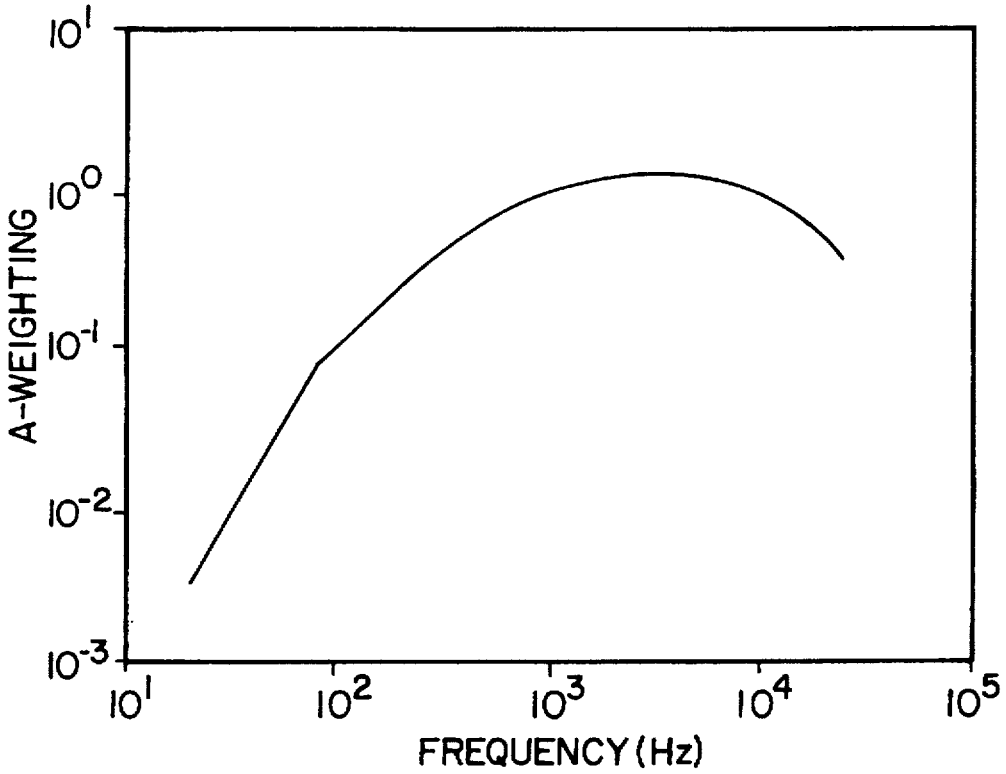
FIG. 3 depicts the A-weighting curve commonly accepted as the acoustic sensitivity of the ear.

This bandwidth of sound is important with respect to the characteristic frequency response of the biomechanical transduction which takes place in the ear. The frequency response of the ear is generally represented by the A-weighting curve as illustrated in FIG. 3. A-weighting is a generally accepted method of assigning a weight to a measurement obtained with a transduction device such as a microphone that is related to the sensitivity of the ear at that frequency. Kinsler, L. E., A. R. Frey, A. B. Coppens and J. V. Sanders, 1982. *Fundamentals of Acoustics*, Third Edition, John Wiley & Sons, Inc., Canada, pp. 246–278. Kinsler et al., 1982). As illustrated in FIG. 3, the peak sensitivity of the ear occurs between 2000 Hz and 3000 Hz, and thus the central audio loudspeaker 24 can be used to "fill" the "center stage" with sound without deteriorating the sonic image because it is centrally located.

At very low frequencies, below approximately 350 Hz, the ear relies on ITD to resolve the location from which sound emanates; however, the wavelength of sound so far exceeds the dimension of the head at frequencies below 350 Hz that low frequency sounds appear omni-directional. Thus, the sub-woofers 32 and 34 can be provided with a mono signal and used to generate the entire bass response without deteriorating the perception of the sonic image. The sub-woofers 32 and 34 are located in the front corner of the enclosure to take advantage of spatial signal processing as well. Placing the sub-woofers 32 and 34 in the corners provides a mechanism for coupling to all of the room modes at very low frequencies and increasing the effective sound power in a region where the sensitivity of the ear is diminished, as illustrated in FIG. 3.

To confirm this statement, consider a modal model of room acoustics at low frequencies where the modal density is sufficiently low to support such a model. The modal model can be derived from the homogeneous wave equation:

$$[\nabla^2+k^2]p(x,t)=0. \tag{1}$$

where $\nabla^2$ is the Laplacian in an appropriate coordinate system (i.e., rectangular, cylindrical, etc., depending upon the shape of the enclosure respectively), k is the acoustic wavenumber, and p(x,t) is the acoustic pressure at the vector field point x. Assuming a series solution to the partial differential equation which is separable in space and time:

$$p(x,t)=\sum_{n=0}^{\infty} p_n(t)\psi_n(x) \tag{2}$$

where $p_n(t)$ is the response in generalized coordinates and $\psi_n(x)$ is the n-th acoustic mode shape of the enclosure. It is well documented, as in Morse, P. M. and K. U. Ingard, 1986. *Theoretical Acoustics*, Princeton University Press, pp. 576–599; Pierce, A. D., 1989. Acoustics, Acoustical Society of America, pp. 284–286; Fahy, F. 1985. *Sound and Structural Vibration*, Academic Press, New York, pp. 241–260 that the acoustic mode shapes of a rectangular enclosure can be expressed as follows:

$$\psi_n(x)=A_n\cos\left(\frac{n_x\pi x}{L_x}\right)\cos\left(\frac{n_y\pi y}{L_y}\right)\cos\left(\frac{n_z\pi z}{L_z}\right). \tag{3}$$

where $A_n$ is the modal amplitude, $L_x$ is the dimension of the enclosure in the x-direction, $n_x$ is the modal index for the x-direction and similarly for the remaining variables.

The critical observation to be made is that if the radiating surface is placed in a corner of the enclosure, regardless of the modal index, each cosine term is unity since the spatial position corresponds to a maximum of the cosine function. This mathematical result demonstrates that the acoustic source can effectively couple uniformly to all acoustic modes of the enclosure and excite the modes with uniform phase below the first resonance frequency of the enclosure (excluding the rigid-body mode). For a typical enclosure with dimensions of 3.5 m by 4 m by 2.4 m, the resonance frequency ($f_n$) of the first acoustic mode can be computed from the following expression:

$$f_n=\frac{c}{2}\sqrt{\left(\frac{n_x}{L_x}\right)^2+\left(\frac{n_y}{L_y}\right)^2+\left(\frac{n_z}{L_z}\right)^2} \tag{4}$$

Hence, for the dimensions provided, the first resonance occurs at approximately 70 Hz. In addition, the acoustic source can be physically placed at some finite distance from the corner to spatially "roll-off" the response of the enclosure to the loudspeaker by virtue of spatial signal processing since the magnitude of the cosine term diminishes as the distance from the surface increases.

Figure 5:
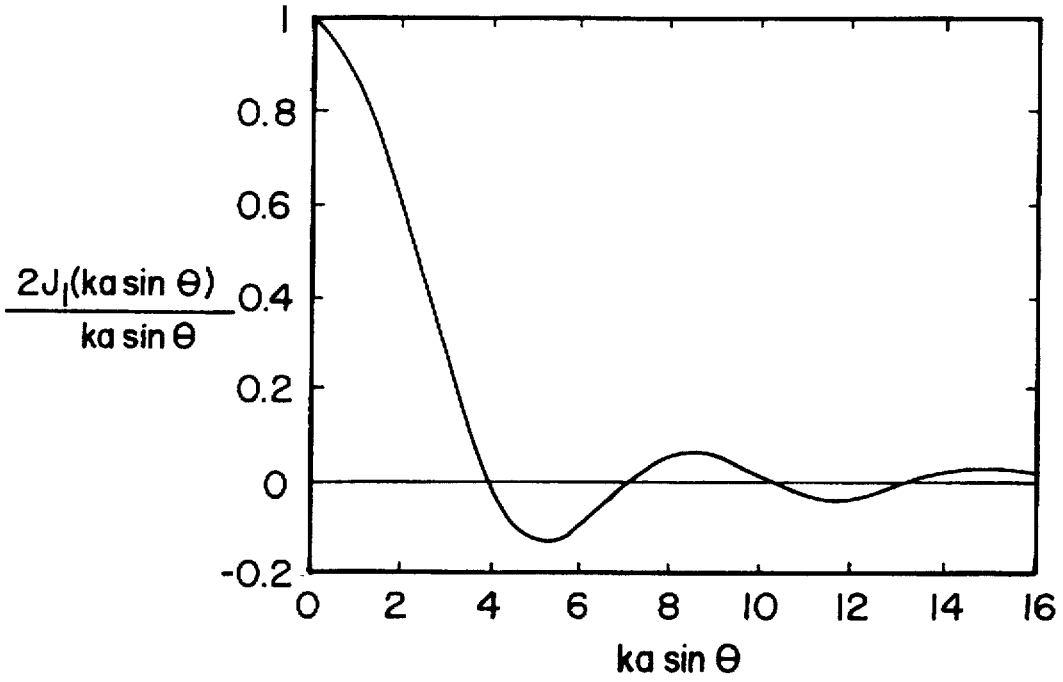
FIG. 5 is the directivity function associated with piston sources (speakers)

In order to discuss the radiation characteristics of speakers, a simplified speaker radiation model will now be presented. For the purpose of this discussion an acoustic driver will be modeled as a piston source. The far field pressure radiating from a vibrating piston source can be expressed as Fahy, F. 1985. *Sound and Structural Vibration*, Academic Press, New York, pp. 241–260:

$$p(r,t) = j\rho_o c k a^2 v_n e^{j\omega t} \left[ \frac{2J_1(ka\sin(\theta))}{ka\sin(\theta)} \right] \frac{e^{-jkr}}{2r} \quad (5)$$

where p is the farfield pressure, t is time, j is the square root of −1, $\rho_o$ is the density of air, c is the speed of sound of air, k is the acoustic wavenumber, a is the piston (speaker) diameter, $v_n$ is the velocity of the piston, $J_1$ is the first order Bessel function of the first kind, and θ is the angle from the normal direction to the piston surface. The function in brackets is known as the directional factor, H(θ), and can be expressed as:

$$H(\theta) = \left[ \frac{2J_1(ka\sin(\theta))}{ka\sin(\theta)} \right] \quad (6)$$

which is equal to one for a given diameter speaker at sufficiently low frequencies. A plot of the directional factor, H, as a function of ka sin (θ) is presented in FIG. 5. Note that the independent variable, ka sin (θ), is a function of angle and frequency (through the wavenumber, k). This frequency and angular dependence give rise to a directivity pattern that changes with frequency. Most speakers are quasi-omni-directional at low frequency, but at higher frequency have one or more distinct lobes which cause the SPL emitted to be strong for θ equal to zero and decrease rapidly with increasing angle, θ.

IID is used to position the sonic image and reproduce the stereophonic sound field at frequencies exceeding 3 kHz, thus the left audio loudspeaker 26 and the right audio loudspeaker 28 are preferably positioned midway in the enclosure as shown in FIG. 2 to maximize the IID. For the proposed "center stage," placing transducers on either side of the listener's head will result in the maximum IID, which from a psycho acoustic perspective serves to increase the width of the sonic image.

Figure 6:
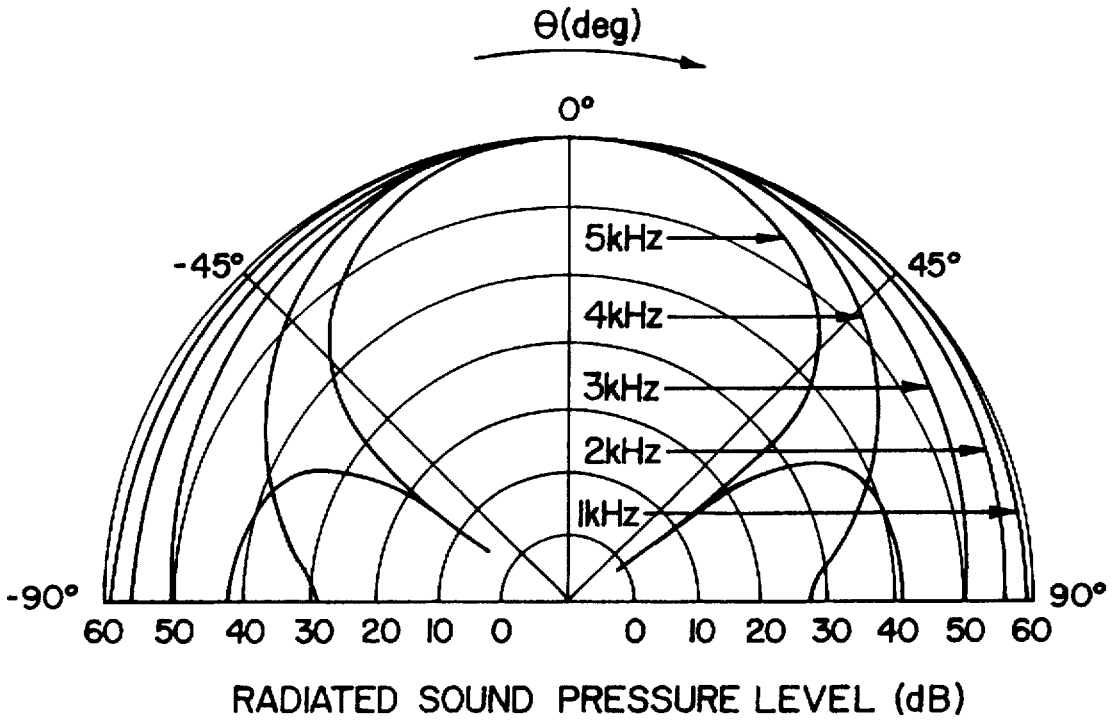
FIG. 6 is the directivity radiation patterns of a 2 inch loudspeaker from 1 to 5 kHz.
Figure 7:
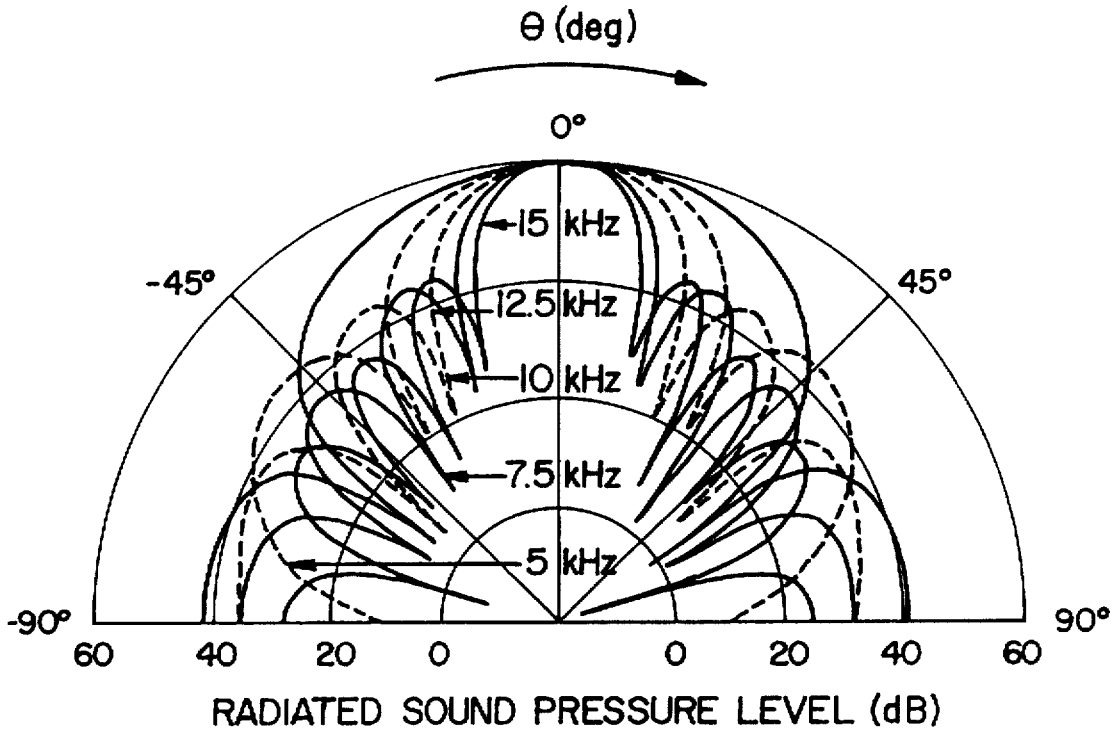
FIG. 7 is a three dimensional directivity plot for a 2 inch loudspeaker at 1 kHz.
Figure 8:
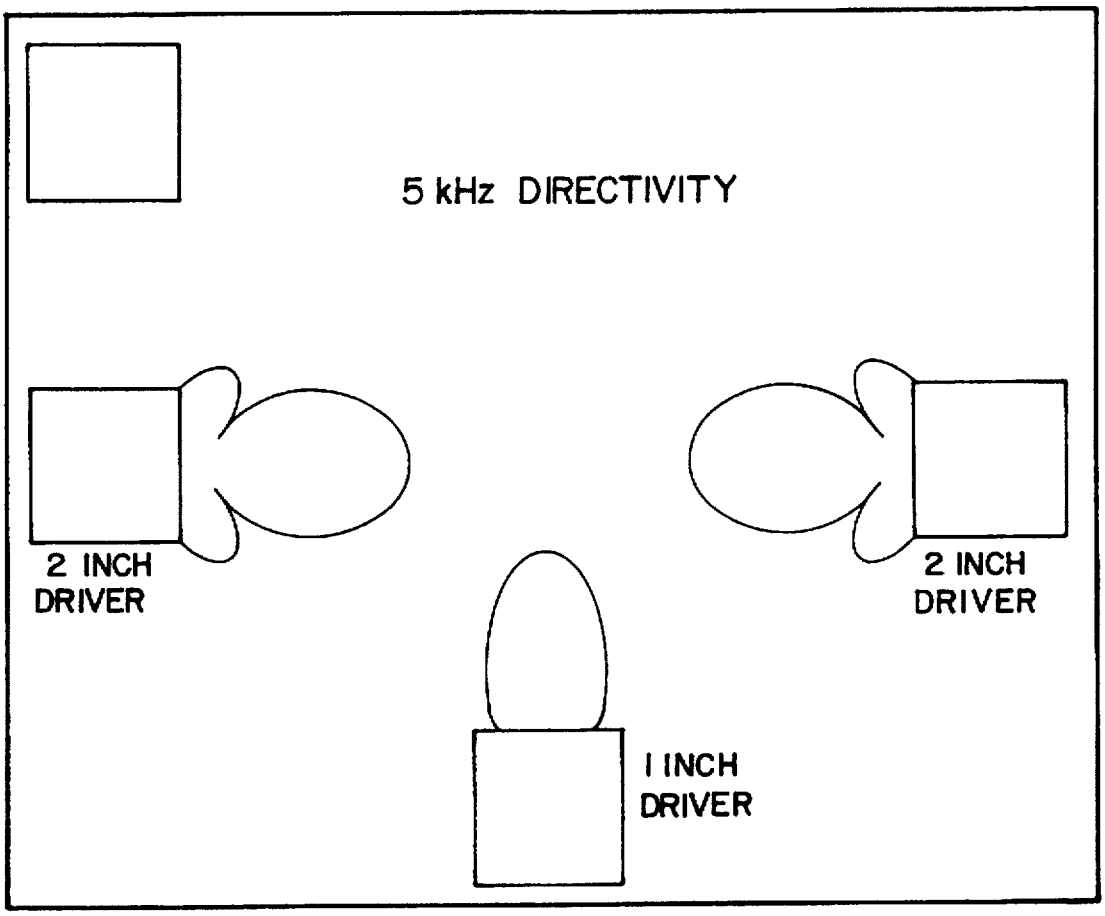
FIG. 8 is a three dimensional directivity plot for a 2 inch loudspeaker at 5 kHz.
Figure 9:
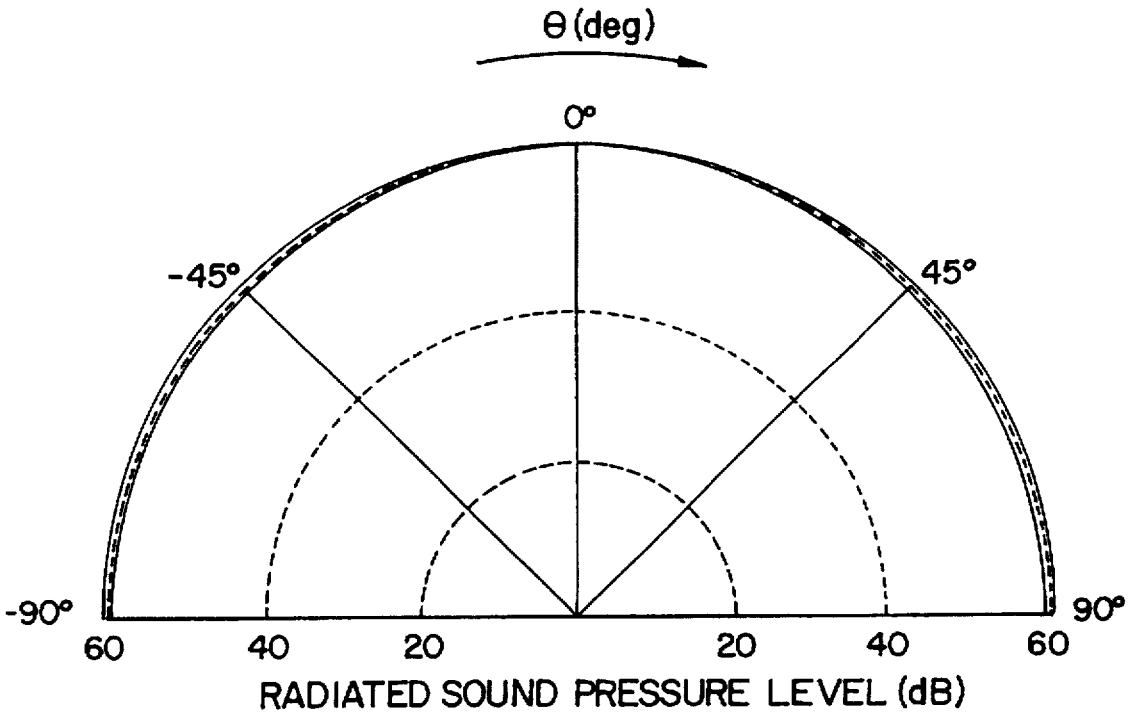
FIG. 9 is the directivity radiation patterns of a 2 inch loudspeaker from 1 to 5 kHz.

This concept will be explained in the following few paragraphs. A plot of directivity for a typical 2 inch diameter driver that can be used for the left audio loudspeaker 26 and the right audio loudspeaker 28 is presented in FIG. 6 for frequencies ranging from 1000 Hz to 5000 Hz. Note that up to about 2 kHz the driver is omni-directional, but at 4 kHz the response at q equal to plus or minus 90 degrees is reduced by approximately 30 dB compared to the response at 0 degrees. It can be seen at 5 kHz that the response consists of 3 lobes with a nodal cone at approximately plus or minus 50 degrees. A three dimensional representation of the 1 kHz directivity is shown in FIG. 7. Note that the response is nearly omni-directional. In contrast, the directivity for the 5 kHz case is presented in the three dimensional plot shown in FIG. 8. As stated previously, the majority of the response is concentrated at q less than 50 degrees. The directivity of the same driver at frequencies ranging from 5 kHz to 15 kHz, plotted in increments of 2.5 kHz is shown in FIG. 9. For this frequency range, the response contains between 3 and 9 lobes with sound pressure responses 20 dB or more down for angles over 45 degrees away from the normal.

Figure 10:
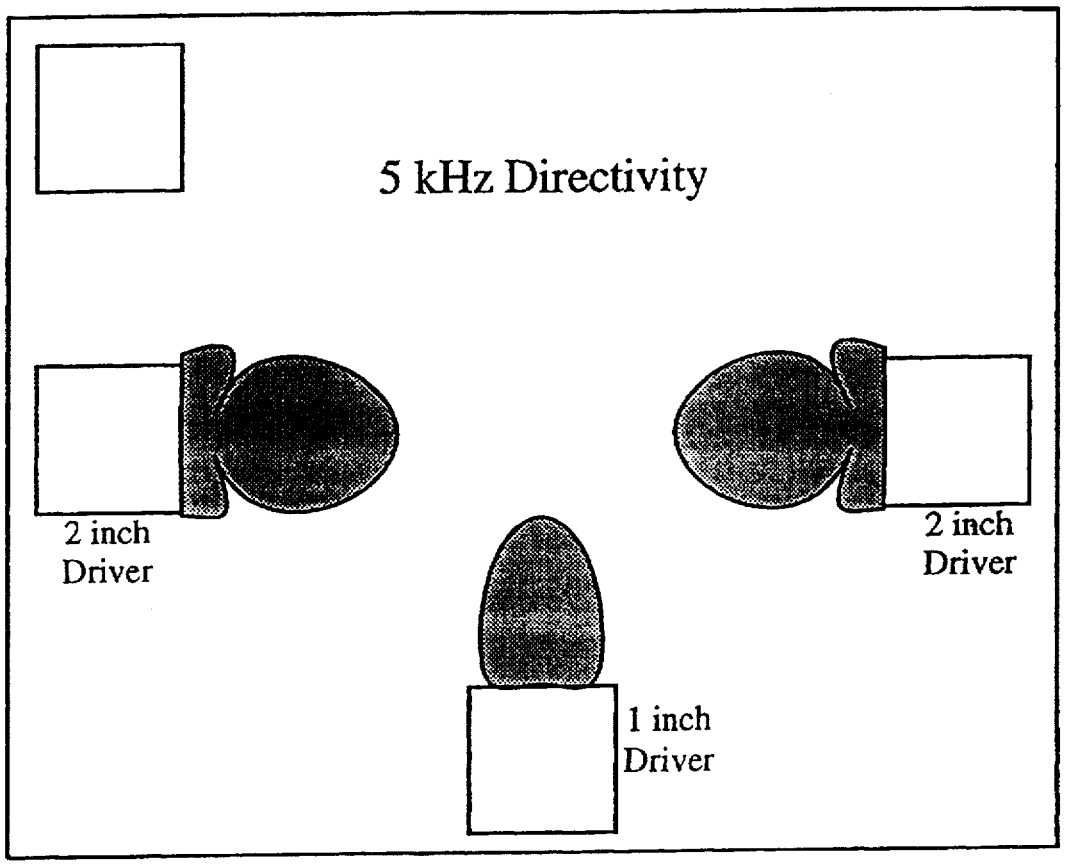
FIG. 10 illustrates a conceptual diagram of the directivity associated with the left audio loudspeaker, the right audio loudspeaker an the high frequency device as shown in FIG. 2.

As previously discussed, the perception of direction is found using the method for frequencies above 3 kHz. Moreover, for transient signals the perception of direction is most affected by the direction associated with the first arrival of a sound (Moore, 1989). Thus, if a sound first arrives from a direct path from the speaker to the ear, and also at some time later arrives from a reflected path (due to room reverberance), then the binaural auditory system perceives the source to be located at a direction corresponding to that of the first arrival. For the left audio loudspeakers 26 and the right audio loudspeaker 28 with 2 inch diameters, the acoustic response is highly directional at frequencies greater than 4 kHz, and thus the location dictated in FIG. 2 will enhance the perceived stereo separation due to the direct path from the driver to the ear, and from the increased response of the direct signal (due to the directivity of the driver) versus the reflected signals. This concept is illustrated diagrammatically in FIG. 10 which depicts the typical directivity patterns of the left audio loudspeaker 26 and the right audio loudspeaker 28 (assumed 2 inch drivers), and the high frequency loudspeaker 36 (assumed 1 inch driver) at a frequency of 5 kHz. As one moves around within the enclosure, a clear left and right stereo image prevails and the audience thus benefits from an expanded "sweet spot." One no longer needs to sit in a very narrow region to enjoy the full audio experience. In some sense, the audience is now "on stage" during the performance as opposed to being far removed. This results from the perceived increase in width of the room. If one were to consider the left audio loudspeaker 26 and the right audio loudspeaker 28 as an array of transducers, it is clear that regardless of the audiences' position within the room, a full left and right channel is perceived. The bandwidth of stereophonic signals delivered to these transducers ranges from 900 Hz to 16 kHz. Except for very youthful audiences, the typical audible bandwidth ranges from approximately 50 Hz to 15 kHz, so the stereo image is clear within the bandwidth supplied to the left audio loudspeaker 26 and the right audio loudspeaker 28. Most of the stereophonic imaging techniques currently used in industry rely on differences in signal magnitude between channels and not time delays as noted in Moore, B. C. J., 1989. An Introduction to the Psychology of Hearing, Third Edition, Academic Press, New York, and thus are perfectly suited for the arrangement of the left audio loudspeaker 26 and the right audio loudspeaker 28.

Figure 11:
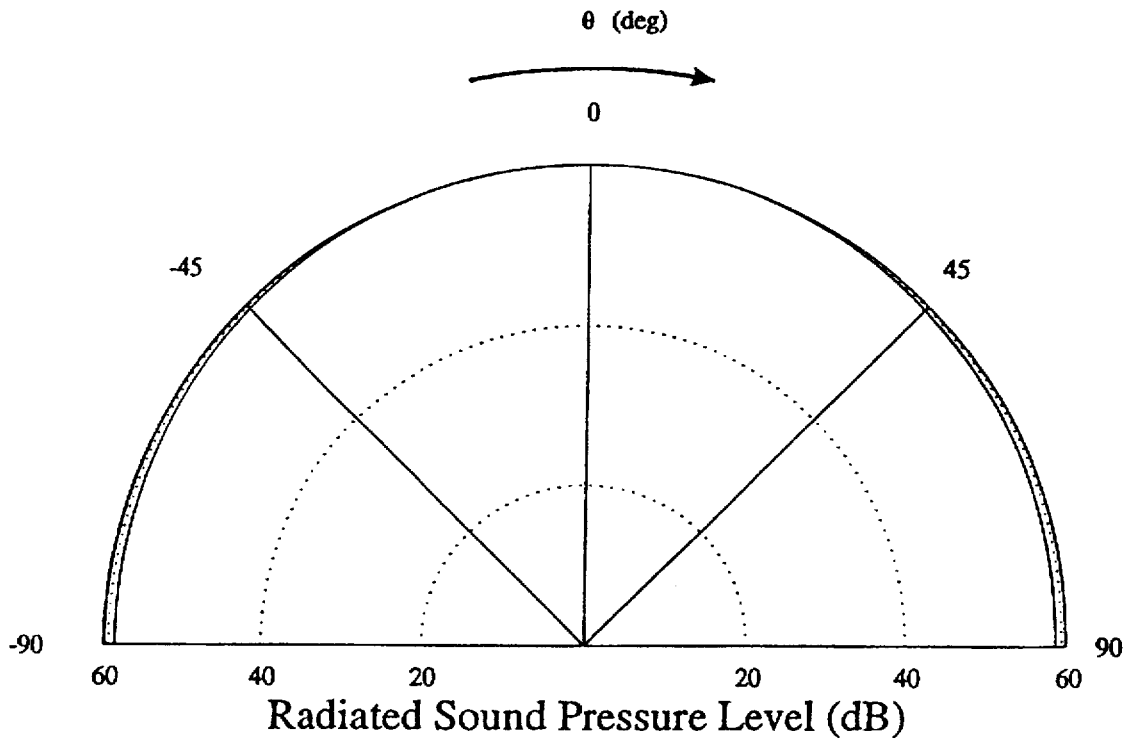
FIG. 11 is the directivity radiation patterns of an 8 inch sub-woofer from 100 to 300 Hz.

The directivity of a preferred 8 inch diameter driver which can be used for sub-woofer loudspeakers 32 and 34 of FIG. 2 is presented in FIG. 11 for frequencies corresponding to 100, 200, and 300 Hz. It can be seen that the driver is quite omni-directional up to 300 Hz, and thus its orientation with respect to the room is relatively unimportant.

Finally, to complete the acoustic envelope created for the listener 30, the high frequency driver 36 is positioned in the rear of the enclosure or centrally overhead. The signal supplied to this device is summed mono and ranges from 4–6 kHz to the limit of the device, exceeding 20 kHz by design. The psychoacoustic purpose of this device is to create the sonic illusion of a more reverberant sound field. High frequency sound is typically absorbed by the audience, carpet, seating and other such absorptive materials within the enclosure. The high frequency device 36 creates the illusion of a more live sound field without deteriorating the sonic image since the pinna naturally attenuates sounds emanating from the rear of the head, Hebrank, J. H. and D. Wright, 1975. "Spectral cues used in the localization of sound sources on the median plane," *Journal of the Acoustical Society of America*, 58. Hebrank and Wright, 1975). This attenuation is consistent with attenuation which would occur from natural reflections of sound waves off boundaries in a reverberant enclosure.

The four dimensional acoustical audio system according to the invention is supported by the principles outlined in psycho acoustics and utilizes both spatial and temporal signal processing consistent with the method by which humans resolve the direction from which sound emanates to maximize the psycho acoustic impact. The transducers are positioned and supplied with temporally filtered signals to increase the sonic width and depth of the enclosure and produce an acoustic field more consistent with a live performance in a reverberant enclosure.

Figure 4:
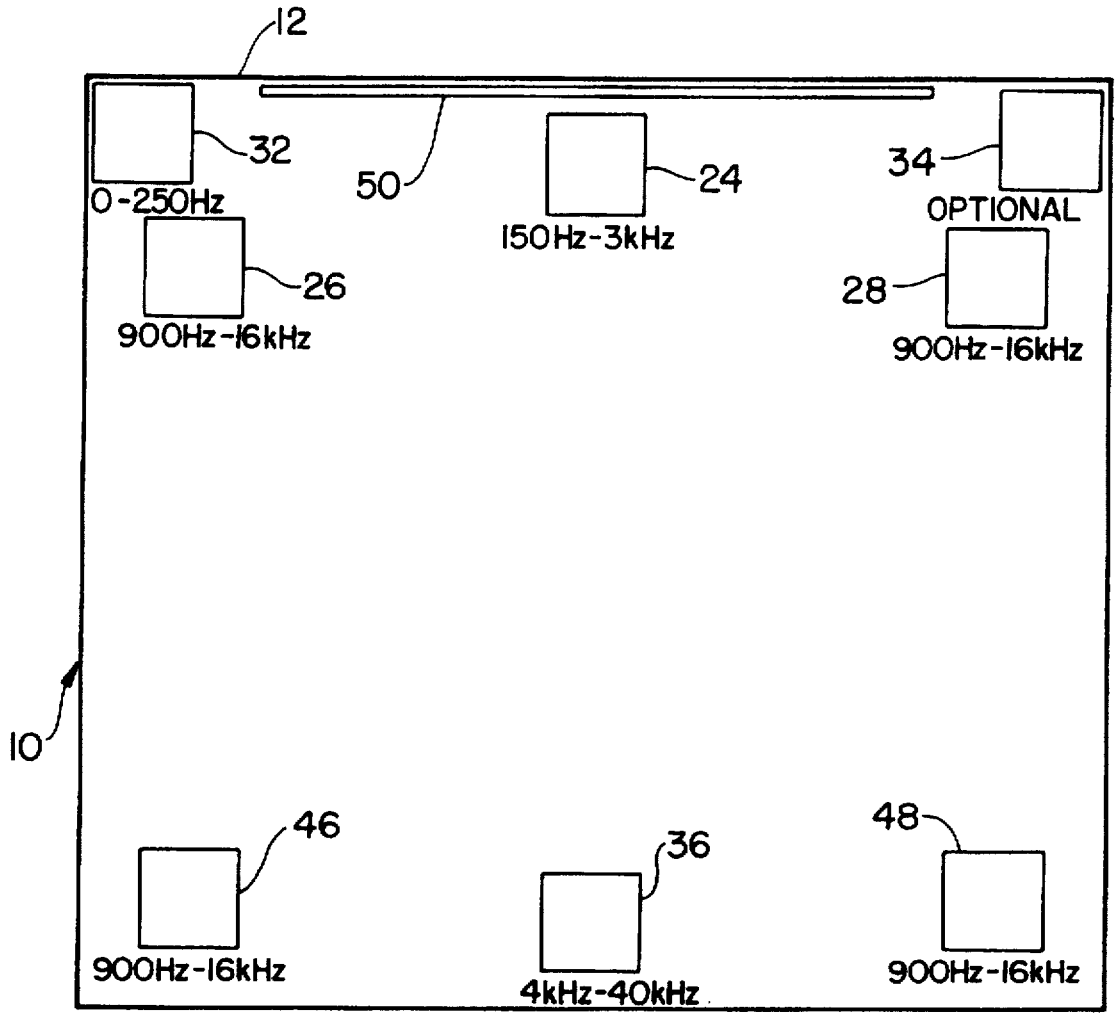
FIG. 4 illustrates an alternative embodiment configured for monitoring motion pictures or other visual information.

An alternative embodiment of the invention developed consistent with these principles is particularly directed to achieving an immersive experience in connection with audiovisual presentations, such as viewing a motion picture. Referring to FIG. 4, the arrangement can be constructed in a fashion similar to the immersive embodiment discussed above. In particular, the system can include a central audio loudspeaker 24, a left audio loudspeaker 26, a right audio loudspeaker 28, a sub-woofer audio loudspeaker 32 and a high frequency device 36 according to the specifications set forth above. Additionally, the alternative embodiment can further include a left rear audio loudspeaker 46 and a right rear audio loudspeaker 48 having substantially the same frequency input ranges as the right audio loudspeaker 28 and the left audio loudspeaker 26. The rear left audio loudspeaker 46 and the rear right audio loudspeaker 48 are preferably positioned from the front wall 12 rearward of the left audio loudspeaker 26 and the right audio loudspeaker 28. The enclosure 10 can include a motion picture viewing screen 50 or a video monitor on the front wall 12 to orient the observer toward the front wall 12 and provide visual information.

Although details of preferred embodiments of the invention have been described herein, it is not intended that the invention is limited to these details. Alternative applications and embodiments of the invention are possible and will likely become apparent in view of this disclosure. Accordingly, the scope of the invention should only be determined by the following claims.

I claim:

1. A multi-dimensional acoustical audio system for immersive observation by a binaural auditory system in an enclosure having a front wall adjoining, at a first corner, a left wall and, at a second corner, a right wall, the left wall and the right wall extending rearwardly from the front wall, a sound field for an acoustic image being created in said enclosure, said audio system comprising:

a central audio loudspeaker placed substantially centrally between the left wall and the right wall, said central audio loudspeaker having a band-limited input ranging in frequency from approximately 150 Hz to no more than approximately 10 kHz, creating a central image in, and greater depth to the sound field; and, a left side audio loudspeaker placed adjacent the left wall and a right side audio loudspeaker placed adjacent the right wall of the enclosure, said left side audio loudspeaker and said right side audio loudspeaker each being placed rearwardly of said central audio loudspeaker and each having a main stereophonic channel as an input, said channels each being band-limited to range in frequency from approximately 900 Hz to approximately 16 kHz, the left and right side audio loudspeakers being positioned with respect to one another to create a maximum width of the acoustic image and produce a stereophonic effect.

2. The system according to claim 1, wherein the frequency range of the input to the central audio loudspeaker is band-limited to an upper frequency of not more than approximately 6 kHz.

3. The system according to claim 1, wherein the frequency range of the input to the central audio loudspeaker is band-limited to an upper frequency of not more than approximately 3 kHz.

4. The system according to claim 1, further comprising at least one sub-woofer audio loudspeaker having at least one low pass filtered input having a cutoff frequency of less than approximately 1000 Hz, said sub-woofer audio loudspeaker being placed adjacent a wall of the enclosure to acoustically couple the sub-woofer audio loudspeaker to the dynamics of the enclosure.

5. The system according to claim 4, wherein the cutoff frequency of the low pass filtered input is less than approximately 600 Hz.

6. The system according to claim 4, wherein the sub-woofer audio loudspeaker is placed in one of the first corner and the second corner.

7. The system according to claim 4, further comprising a high frequency device placed substantially centrally between the left wall and the right wall, and at any location in a range of positions from a first position in substantial alignment with the left audio loudspeaker and the right audio loudspeaker and a second position rearward of said first position, said high frequency device having a band-limited input having an upper frequency limit which is greater than approximately 15 kHz, the high frequency device creating an the illusion of greater reverberation.

8. The system according to claim 7, wherein the high frequency device has a band-limited input in a high range of frequencies from approximately 4 kHz to greater than approximately 20 kHz.

9. The system according to claim 7, wherein the enclosure is a room and has a rear wall opposite said front wall and adjoining said left and right walls.

10. The system according to claim 7, wherein the cutoff frequency for the sub-woofer audio loudspeaker is approximately 250 Hz.

11. The system according to claim 7, wherein the band-limited inputs to the left audio loudspeaker and the right audio loudspeaker have an upper frequency of approximately 12 kHz.

12. The system according to claim 7, wherein the left audio loudspeaker and the right audio loudspeaker are located rearwardly from the the central audio loudspeaker and the sub-woofer audio loudspeaker.

13. The system according to claim 7, wherein the high frequency device is placed vertically higher in the enclosure than the left audio loudspeaker and the right audio loudspeaker.

14. The system according to claim 13, wherein the enclosure has a ceiling, and the high frequency device is placed adjacent said ceiling.

15. The system according to claim 7, further comprising a rear left audio loudspeaker and a rear right audio loudspeaker, each also having a band-limited input, said input ranging in frequency from approximately 900 Hz to approximately 16 kHz, said rear left audio loudspeaker and said rear right audio loudspeaker being placed rearwardly of said left audio loudspeaker and said right audio loudspeaker, said first position of said range of positions of said high frequency device being in substantial alignment with said rear left audio loudspeaker and said rear right audio loudspeaker and said range extending rearwardly of said first position.

16. The system according to claim 15, further comprising a video screen placed rearward from the front wall and forward of the left and right audio loudspeakers.

17. The system according to claim 15, wherein the enclosure has a ceiling and said high frequency device is placed adjacent the ceiling.

18. The system according to claim 7, further comprising a multichannel sound source and amplifier system for providing audio signals as said inputs to said central audio loudspeaker, left audio loudspeaker, right audio loudspeaker, sub-woofer audio loudspeaker and said high frequency device.

19. The system according to claim 18, wherein said multichannel sound source and amplifier system provide a separate channel output to each of the left audio loudspeaker, the right audio loudspeaker, and the central audio loudspeaker and provides a first summed-to-mono signal to the sub-woofer audio loudspeaker and a second summed-to-mono signal to the high frequency device.

20. The system according to claim 15, further comprising a multichannel sound source and amplifier system for providing audio signals as said inputs to said central audio loudspeaker, said left audio loudspeaker, said right audio loudspeaker, said sub-woofer audio loudspeaker, said high frequency device, said rear left audio loudspeaker, and said rear right audio loudspeaker, said multichannel sound source and amplifier system providing a separate channel output to each of said left audio loudspeaker, said right audio loudspeaker, said central audio loudspeaker, said rear right audio loudspeaker, and said rear left audio loudspeaker and provides a first summed-to-mono signal to the sub-woofer audio loudspeaker and a second summed-to-mono signal to the high frequency device.

21. A method for creating a multi-dimensional acoustical audio environment for immersive observation by a binaural auditory system in a observation area having a front boundary and left and right side boundaries, a sound field for an acoustic image being created in said observation area, said method comprising the steps of:

band-limiting a first electronic signal to range in frequency from approximately 150 Hz to no more than approximately 10 kHz;

delivering a first acoustic signal, representing said first band-limited electronic signal, from a central position near said front boundary and between said left and right side boundaries, toward the observation area;

said first acoustic signal creating a central image in, and greater depth to the sound field in the observation area;

band-limiting main stereophonic electronic signals to range in frequency from approximately 900 Hz to no more than approximately 16 kHz;

delivering a second acoustic signal, representing one of said band-limited stereophonic electronic signals, from a left side position adjacent said left boundary and inwardly toward the observation area;

delivering a third acoustic signal, representing a different one of said band-limited stereophonic electronic signals, from a right side position adjacent said right boundary and inwardly toward the observation area said left and right side positions being rearward of said central position and located with respect to one another to create a maximum width of the acoustic image and produce a stereophonic effect in the observation area.

22. The method according to claim 21, comprising the step of band-limiting said first electronic signal to no more than approximately 6 kHz.

23. The method according to claim 21, comprising the step of band-limiting said first electronic signal to no more than approximately 3 kHz.

24. The method according to claim 21, further comprising the steps of:

low-pass filtering a fourth electronic signal to a frequency no more than approximately 1000 Hz; and, delivering a fourth acoustic signal, representing said fourth low-pass filtered electronic signal into the observation area.

25. The method according to claim 24, low-pass filtering said fourth electronic signal to a frequency no more than approximately 600 Hz.

26. The method according to claim 24, further comprising the steps of:

band-limiting a fifth electronic signal to a frequency greater than approximately 15 kHz; and, delivering a fifth acoustic signal, representing said fifth electronic signal into said observation area to create an illusion of greater reverberation.

27. The method according to claim 26, comprising the step of band-limiting said fifth electronic signal in a frequency range from not less than approximately 4 kHz to greater than approximately 20 kHz.

28. The method according to claim 24, comprising the step of low-pass filtering said fourth electronic signal to a frequency no more than approximately 250 Hz.

29. The method according to claim 26, comprising the step of band-limiting said stereophonic electronic signals to range in frequency from approximately 900 Hz to no more than approximately 12 kHz.

30. The method according to claim 26, comprising the steps of delivering said second and third acoustic signals into said observation area from locations spaced further from said front boundary than locations from which said first and fourth acoustic signals are delivered into said observation area.

31. The method according to claim 26, comprising the step of delivering said fifth acoustic signal into said observation area from a location which is vertically higher than locations from which said second and third acoustic signals are delivered into said observation area.

32. The method according to claim 26, further comprising the steps of:

placing the observation area within an enclosure having a ceiling; and, delivering said fifth acoustic signal from a location adjacent said ceiling of the enclosure.

33. The method according to claim 26, further comprising the steps of:

band-limiting further electronic signals to range in frequency from approximately 900 Hz to no more than approximately 16 kHz;

delivering a sixth and seventh acoustic signals, respectively representing said further band-limited electronic signals, from respective left and right locations respectively rearward of the left and right side positions from which said second and third acoustic signals are delivered. .

34. The method according to claim 33, further comprising the steps of:

placing a video screen rearwardly of said left and right side positions from which said second and third acoustic signals are delivered.

35. The method according to claim 33, further comprising the steps of:

placing the observation area within an enclosure having a ceiling; and, delivering said fifth acoustic signal from a location adjacent adjacent the ceiling.

36. The method according to claim 26, further comprising the step of: supplying all of said band-limited, high-pass filtered and low-pass filtered signals for said delivery into said observation area from a multichannel sound source and amplifier system.

37. The method according to claim 36, further comprising the steps of:

providing said first, second and third band-limited electronic signals as separate outputs from said multichannel sound source and amplifier system;

providing said fourth low-pass filtered electronic signal as a first summed mono output signal from said multichannel sound source and amplifier system; and, providing said fifth high-pass filtered electronic signal as a second summed mono output signal from said multichannel sound source and amplifier system.

38. The method according to claim 33, further comprising the steps of:

providing said first, second, third, sixth and seventh band-limited signals as separate outputs from a multichannel sound source and amplifier system;

providing said fourth low-pass filtered electronic signal as a first summed-to-mono output signal from said multichannel sound source and amplifier system; and, providing said fifth high-pass filtered electronic signal as a second summed-to-mono output signal from said multichannel sound source and amplifier system.

* * * * *